United States Patent [19]

Casamayor

[11] 4,289,818

[45] Sep. 15, 1981

[54] EXTRUDED WALL PANELING SYSTEM

[75] Inventor: Jorge Casamayor, Columbus, Ohio

[73] Assignee: Plaskolite Inc., Columbus, Ohio

[21] Appl. No.: 16,482

[22] Filed: Mar. 1, 1979

[51] Int. Cl.[3] ..... A47K 3/14; E04B 1/343

[52] U.S. Cl. ..... 428/43; 428/177; 428/217; 428/339; 428/343; 428/354; 52/35; 52/98; 52/288; 4/614

[58] Field of Search ..... 52/35, 98, 288, 287; 428/43, 212, 217, 177, 343, 354, 339; 4/612, 614

[56] References Cited

U.S. PATENT DOCUMENTS

| | | | |
|---|---|---|---|
| 2,771,110 | 11/1956 | Tuck | 52/98 |
| 3,200,547 | 8/1965 | Johnson | 52/288 |
| 3,271,232 | 9/1966 | Moore | 428/43X |
| 3,286,422 | 11/1966 | Pangerl | 52/287 |
| 3,609,927 | 10/1971 | Wine | 52/100 |
| 3,804,684 | 4/1974 | Tokushige et al. . | |
| 3,819,464 | 6/1974 | Ungerer | 428/43 X |
| 3,953,661 | 4/1976 | Gulley | 428/212 X |
| 3,996,703 | 12/1976 | Daniels | 52/35 |
| 4,020,602 | 5/1977 | Daniels | 52/35 |
| 4,091,586 | 5/1978 | Schwartz | 52/35 X |

FOREIGN PATENT DOCUMENTS

| | | | |
|---|---|---|---|
| 2700210 | 7/1978 | Fed. Rep. of Germany | 52/98 |

*Primary Examiner*—George F. Lesmes
*Assistant Examiner*—Alexander S. Thomas
*Attorney, Agent, or Firm*—Kenyon & Kenyon

[57] ABSTRACT

A protective wall paneling kit for recesses, for example, that surround a bath tub or shower stall, is disclosed. The kit, and its several components are primarily of extruded plastic. Extruded sheet panels are provided having a relatively thick structural base member, such as acrylonitrile-butadiene-styrene tripolymer, co-extruded with a thin layer of a protective plastic such as an acrylic having enhanced impact properties. Adjacent panels are joined and outward facing edges are sealed by further extruded joining and sealing strips, of a plastic such as polyvinyl chloride. The strips are of a single profile shape and are adaptable for either use. The panels and strips may be provided with sizing grooves during extrusion to allow convenient size adjustment. The joining and sealing strips may also be of a dual durometer polyvinyl chloride to permit hinging or tear stripe adjustment. The adjustment features allow the kit to be provided in a wide range of standard embodiments made from limited modular sizes. Alternatively, the various kit elements may be separately provided for other various applications.

9 Claims, 20 Drawing Figures

EXTRUDED WALL PANELING SYSTEM

BACKGROUND OF THE INVENTION

In the prior art there have been many types of wall paneling systems including joining members and adapted for adjustability, which are intended for use as bath tub or shower stall surrounds or enclosures. Such surrounds are provided as kits in which a number of separate panels are applied to the exposed surfaces of a recessed wall opening in which a bath tub or shower is located. The paneling used in surrounds must usually be both decorative and protective and requires an exposed surface which is resistant to impact, scratches and chemical breakdown. In the prior art, tub and shower wall surrounds have been provided with laminated or molded panels which may be formed from fiberglass, or tripolymer acrylonitrile-butadienestyrene with an acrylic laminate. See, for example, U.S. Pat. Nos. 3,564,788; 3,740,908; 3,977,136 and 3,996,703.

Generally, surround kits consist of at least (1) a back wall panel, which in turn may consist of one or more separate relatively plane panels, and which may include a center panel portion having an intrinsic soap tray and (2) separate side wall panels, which extend outwardly from ends of the center panel, thus meeting with the center panel at a corner of the recess.

At corners where side wall panels meet another panel, a relatively water resistant seal should be formed. This has been accomplished in the prior art by providing perpendicularly angled corner members, over which the center and side panels are applied, or by some other form of overlapping, cooperating, or sealing element. Effecting a seal at the corner has required relatively complex panel shapes which results in an increase in the total number of members required for a surround. The complexity and size of shapes involved has also presented problems in packaging a wall surround kit. Further, the corner sealing problem has presented design problems in providing an adjustable surround kit. Also, in paneled recesses, the outwardly facing edges of the side panels are normally sealed, covered by a decorative moulding or themselves molded into a shape, to provide protection from water infiltration and to enhance the esthetic appearance of the paneling applied.

Surround kits may be designed for retrofit purposes, such as remodeling, replacing or decorating an existing tub or shower wall recess, as well as for original installation. Water seals are required in the joints between individual adjacent panels, particularly, as stated above, at corners between panels and at exposed end edges of the panels. In the prior art it has been difficult to adapt to seal the exposed edge of a retrofit panel when the panel is applied over an existing wall covering such as tile. Furthermore, when surround kits are used in retrofit applications in which structural changes to an existing recess are not normally contemplated, it is often necessary to adapt paneling to out-of-plumb or out-of-square pre-existing structural inadequacies.

In addition, for either retrofit or original installation kits, the paneling provided should preferably be adjustable to fit existing wall recesses, which may conventionally range from about 40 to 60 inches in length for a tub, and from about 28 to 32 inches in length for a shower recess and from about 28 to 32 inches in depth for both. Adjustability minimizes inventory requirements by allowing relatively few stock kits to fit all sizes of shower stalls and tub recesses and reduces installation error by eliminating the need for measurement, cutting or other significant physical manipulation of the panels.

OBJECT OF THE INVENTION

It is an object of this invention to provide an improved wall recess surround having extruded sheet panels which may be adapted to particular application parameters of cost, appearance and durability. It is another object to provide a wall recess surround kit having easily adjustable members to facilitate installation of the paneling in any size of pre-existing recess.

It is also an object of this invention to provide extruded strips to provide a sealing molding for the corner joints and ends of paneling used in recessed surrounds. It is another object to provide one extruded profile strip which may be used either for corner or edge sealing purposes. It is a further purpose of the invention to provide a sealing strip for the exposed edge of side paneling which is adaptable to various thickness of existing wall coverings over which the paneling is installed, particularly in retrofit installations.

Further objects of the invention are to reduce the number of sizes and shapes of paneling and sealing members required in a particular installation and to reduce both the number and the complexity of the particular elements required in a typical paneling application.

It is another object of the invention to provide improved sealing of the members which comprise a recess panelling system and to provide in a compact kit a wall surround which is economical for its intended application and convenient in its installation.

It is yet another object to provide a surround kit which is easily and economically manufactured by extrusion processes in a variety of forms for various applications. Hence, another object of the invention is to reduce manufacturing steps, which in the prior art have included molding, laminating or vacuum forming. It is yet another object of the invention to provide tear strips or sizing grooves to permit convenient adjustability for particular application.

These and other features of the invention in comparison with shower or tub recess wall surround kits of the prior art will become apparent from the following description of the preferred embodiment.

DRAWINGS

FIG. 1 is a front view of a tub recess in which the tub surround paneling of the invention is installed. The interior surfaces of the recess have protective panels applied. Sealing strips seal the corner joints and front edges of the panels.

Figure 12:
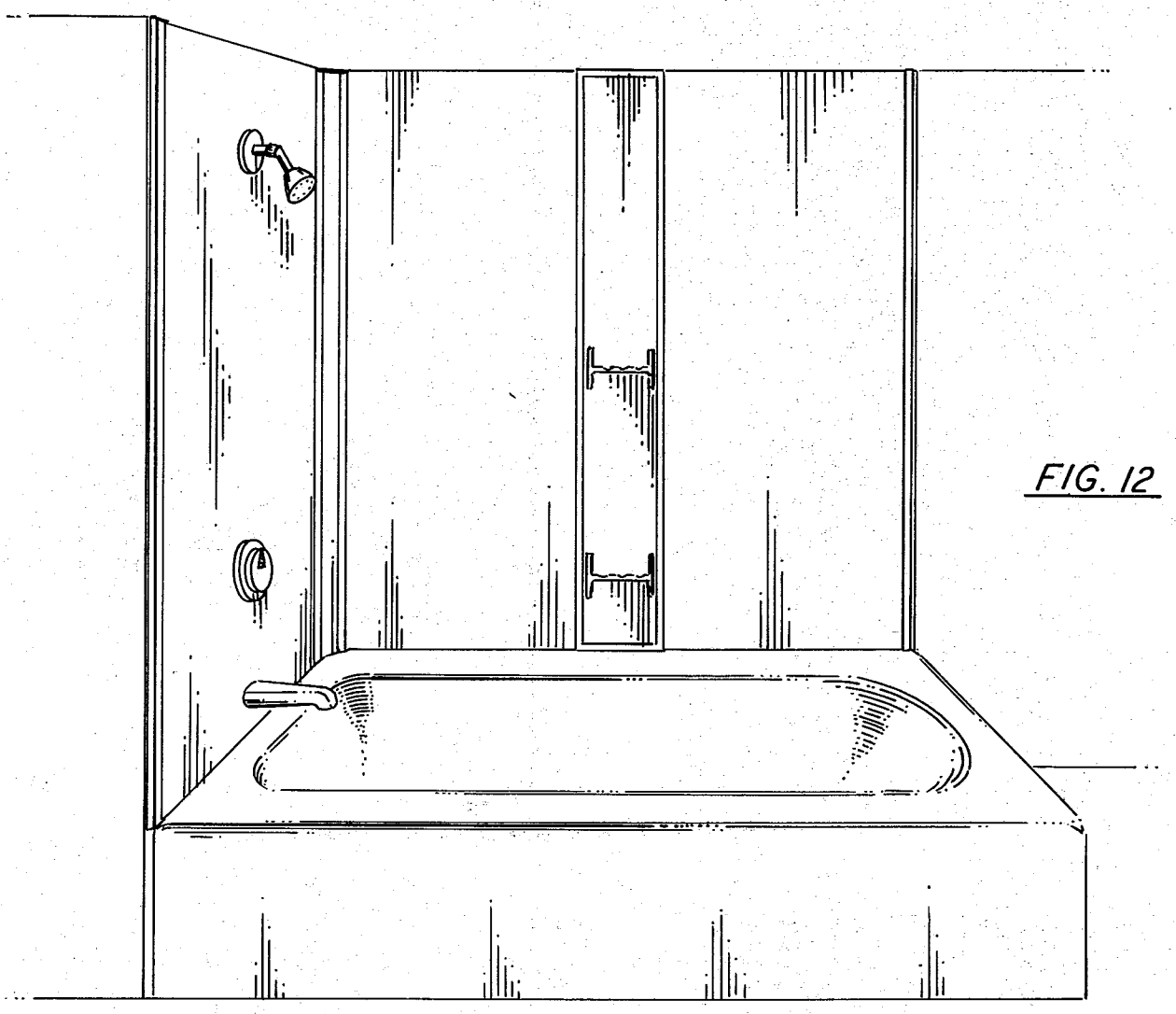
Figure 12A:
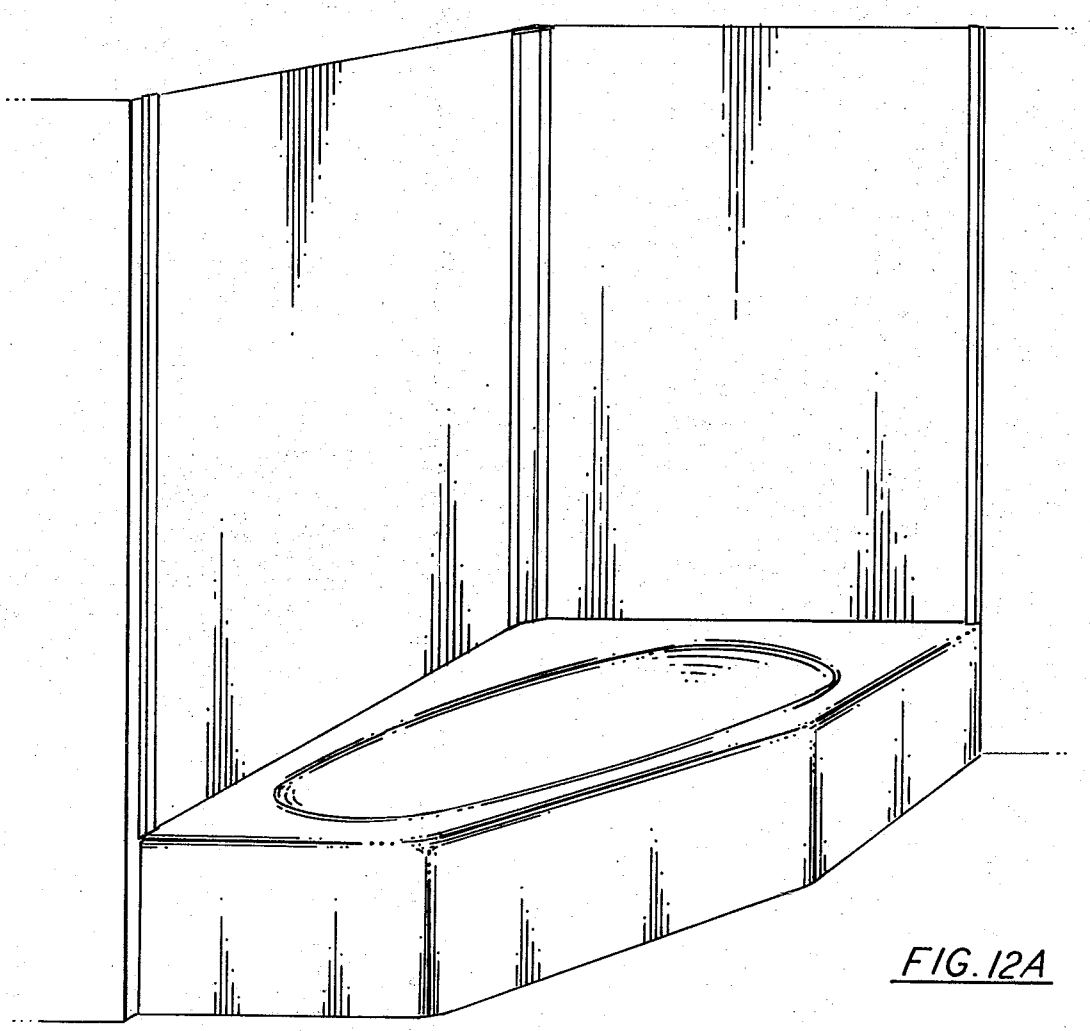

FIGS. 12 and 12A respectively, are perspective drawings which depict the paneling system applied in an "L" shaped corner recess and a corner recess in which a tub is diagonally located.

DESCRIPTION OF THE INVENTION

The paneling system of the invention consists of adjustable extruded panels and corner and side edge sealing strips. The side edge sealing strips may also be adjustable in certain embodiments of the invention.

Figure 1:
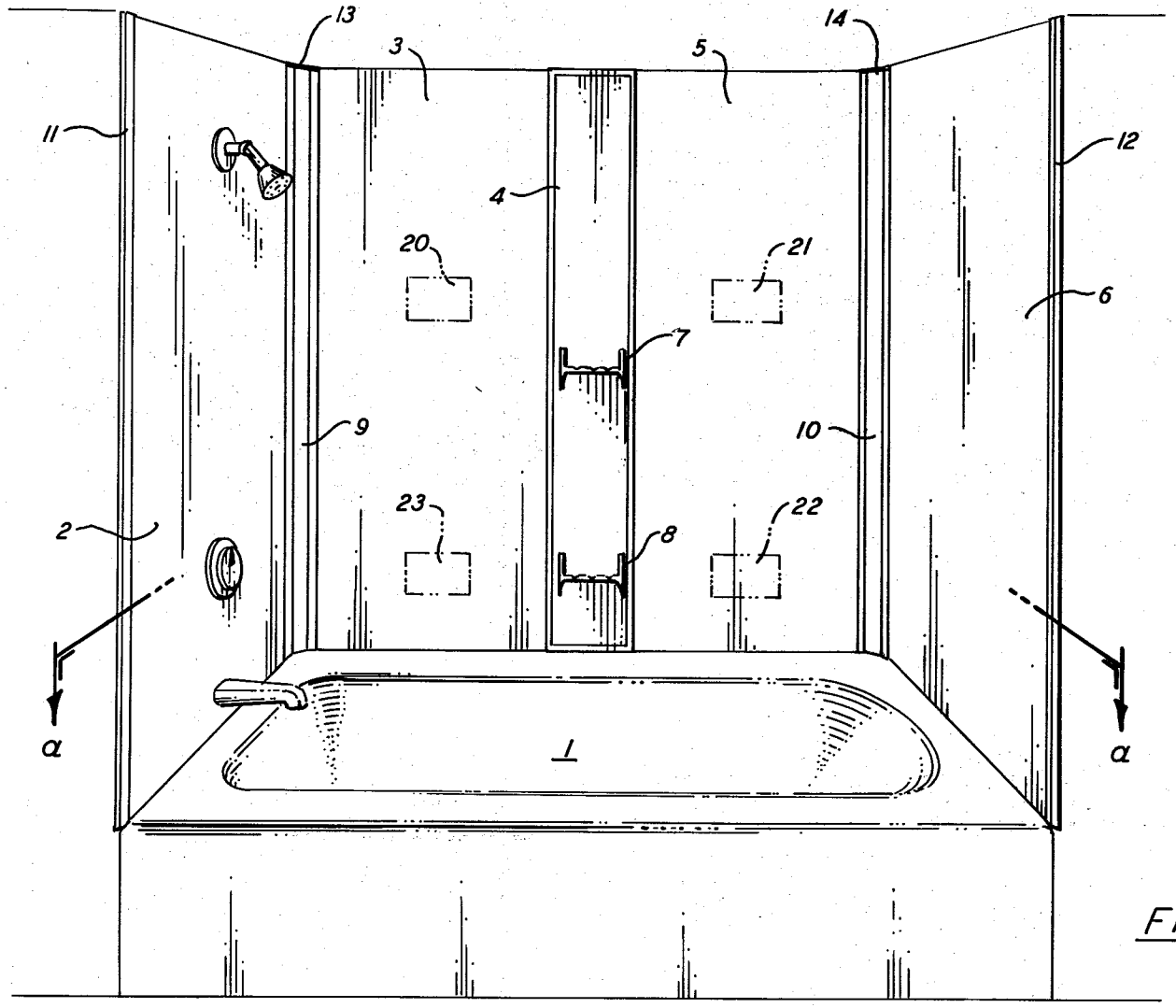
FIG. 1A is a cross-sectional view of the enclosure of FIG. 1 taken through line a—a.

Referring to FIG. 1 in which the paneling system is applied as a tub surround, a tub 1, is located in an existing wall recesses in which protective panels 2, 3, 4, 5 and 6 are applied to the three sides of the recess and protect the recess wall.

Figure 7:
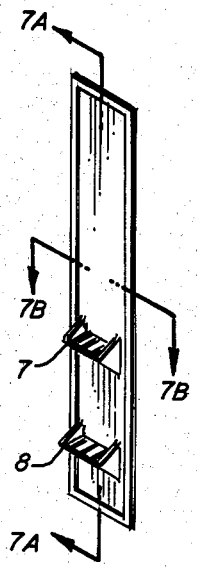
FIGS. 7, 7A and 7B are respectively perspective views and cross section views thru lines a—a and b—b of FIG. 7 of a form of center panel used at the back wall of the recess.

The panels more particularly consist of back panels 3 and 5, joined by center panel 4. Side panels 2 and 6 extend from the back corners of the recess to the front opening of the recess. The center panel depicted in greater detail in perspective in FIG. 7 may be provided with one or more soap trays or other trays for holding hygiene products used in bathing. Such trays are indicated at 7 and 8 in FIG. 1 and FIG. 7 and may be intrinsically molded into the center panel. The center panel may be flat and one or more trays may be separately provided for installation by the consumer at a discretionary location on the paneled recess.

Figure 8:
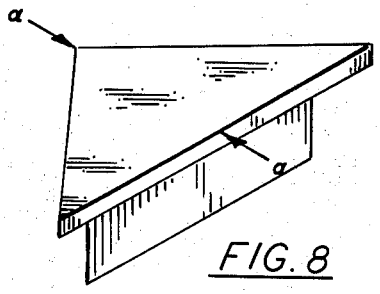
FIGS. 8 and 8A depict a corner cap element, and cross-section thereof, of the tub surround.
Figure 8A:
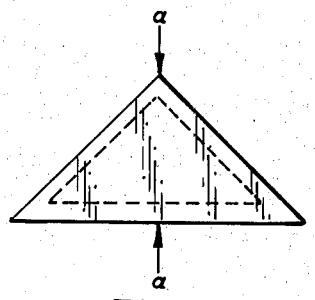

Sealing strips 9 and 10 overlap the edges of the back and side panels and seal the corners between the back and side panels. Corner caps, such as depicted in FIG. 8 may be used to plug the triangular opening formed by the corner and the corner sealing strips. Such caps are inserted at 13 and 14. The front edges of side panels extending from the recess are sealed by edge strips 11 and 12. In the cross section of FIG. 1A and the exploded view of FIG. 2 the relationship of the tub, existing wall recess, panels, strips and caps is clearly depicted. In one aspect the invention consists of a kit providing members which comprise, when installed, a finished tub or shower surround.

The kit generally consists of extruded plastic panels and strips which are easily adapted to a variety of forms for various applications.

Figure 3:
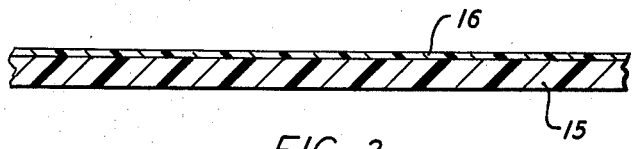
FIG. 3 is an exaggerated cross section through the thickness of the co-extruded paneling of the invention.

A number of separate flat, plane extruded wall panels are provided for installation on back and side surfaces. The composition of the panels may be optionally adjusted to enhance appearance, increase durability or reduce cost, based on the particular application requirements of a particular kit. In the preferred embodiment, a flat, co-extruded sheet of polymeric material is provided in a thickness of about 0.060 to 0.080 inches, up to about 0.100 inches. Typically, the sheet consists of a thick base of a structural polymeric material such as Acrylonitrile—Butadiene—Styrene, ("ABS") tripolymer, which on one side is integrally co-extruded with an acrylic plastic layer having enhanced impact properties, and having a thickness of about 0.002 to 0.025 inches. The thinner acrylic layer constitutes the visible, outward facing surface of the panel when installed. In an exaggerated cross section through such a panel in FIG. 3, the base of structural polymeric material is indicated by 15, with the layer of impact acrylic material indicated by 16.

Conventionally in the prior art such as described in U.S. Pat. No. 3,977,136, tub enclosure panels include a tripolymer base about 0.057 to 0.060 inches in thickness with an acrylic layer 0.003 inches thick laminated thereon. Whereas such prior art panels have been laminated, the panels of the invention are co-extruded to allow significant advantages to be achieved in fabrication and design. Thus, the surface of the surround paneling which is outwardly facing may be particularly adapted in properties to the requirements of a predetermined application by adjusting the thickness of the co-extruded layer of acrylic with enhanced impact properties. Normally, a thin layer of impact acrylic about 0.002 to 0.006 inches is co-extruded on a base of about 0.057 inches, however, to provide greater chemical resistance, improved scratch resistance, or enhanced visual appearance or repairability, the thickness of the impact acrylic co-extruded layer may be suitably increased to provide such qualities to the degree required for a particular application. This is in contrast with the limitations of prior art laminated panels which are able to provide an acrylic layer only in a thickness in which a laminating film is commercially available, typically in a 0.002 to 0.006 inches thickness range. Thus, an unlimited range of thicknesses of acrylic of up to about 0.025 inches may be provided for panels of the invention, depending on application requirements.

Furthermore, a choice of compatible protective and base layers is allowed in the co-extruded panels. Such materials can be determined by cost or quality requirements of an application. Hence, a far greater range of design can be achieved with co-extruded panels than is possible with laminated panels which are restricted to thicknesses of commercially available impact acrylic laminates.

Figure 6:
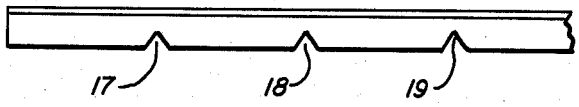
FIG. 6 is a cross section of paneling and depicts the size adjustment grooves provided within the back surfaces of panels of the invention.

The extruded panels also allow greater size adjustability through the inclusion of "breaking" grooves or notches which are intrinsically extruded into the back surface of the panel at predetermined locations along side edges. Thus in a typical kit for a tub surround, two back panels 26×60 inches are provided with a 10 inch wide center panel. Normally, this permits adjustability of the kit for use in tub recesses from about 50 to 61 inches wide, if 0.5 inch on each side of both panels is allowed for gluing to the center panel and corner molding at the widest measurement. Because the back of the panels, however, is intrinsically formed with "breaking" grooves at predetermined intervals as each panel is extruded, cutting to smaller sizes is facilitated and the kit is conveniently adaptable to narrower recesses. For example, with three breaking grooves on each panel 2 inches apart, it is possible to permit adjustability to range from 40 to 61 inches. Such grooves permit accurate and clean cutting of the panel along the grooved or notched "break" line. On the two side panels, such grooves would be similarly provided to allow adjustability for varying depths of recesses. For example, if similar grooves were provided at like intervals at one edge of a 28 inch side panel, the kit would be adjustable for recesses from about 29 to 23 inches in depth. Preferably, such intrinsically extruded grooves are sharply "V" shaped extending the length of the panel. The depth of such grooves in the thickness of the panel would typically not exceed about half the panel thickness. Such spaced sizing grooves are indicated in the panel cross section of FIG. 6 in which the grooves are indicated at 17, 18 and 19.

Figure 1A:
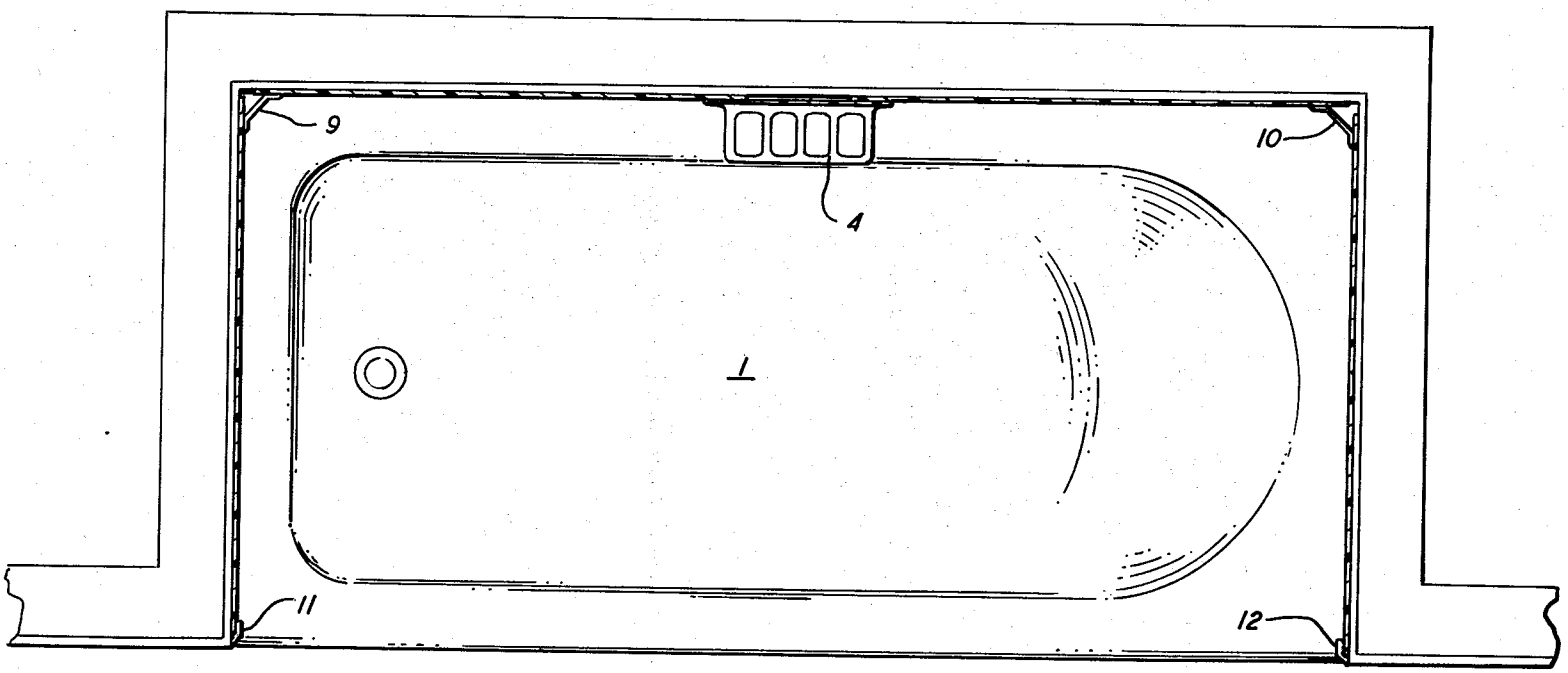
Figure 2:
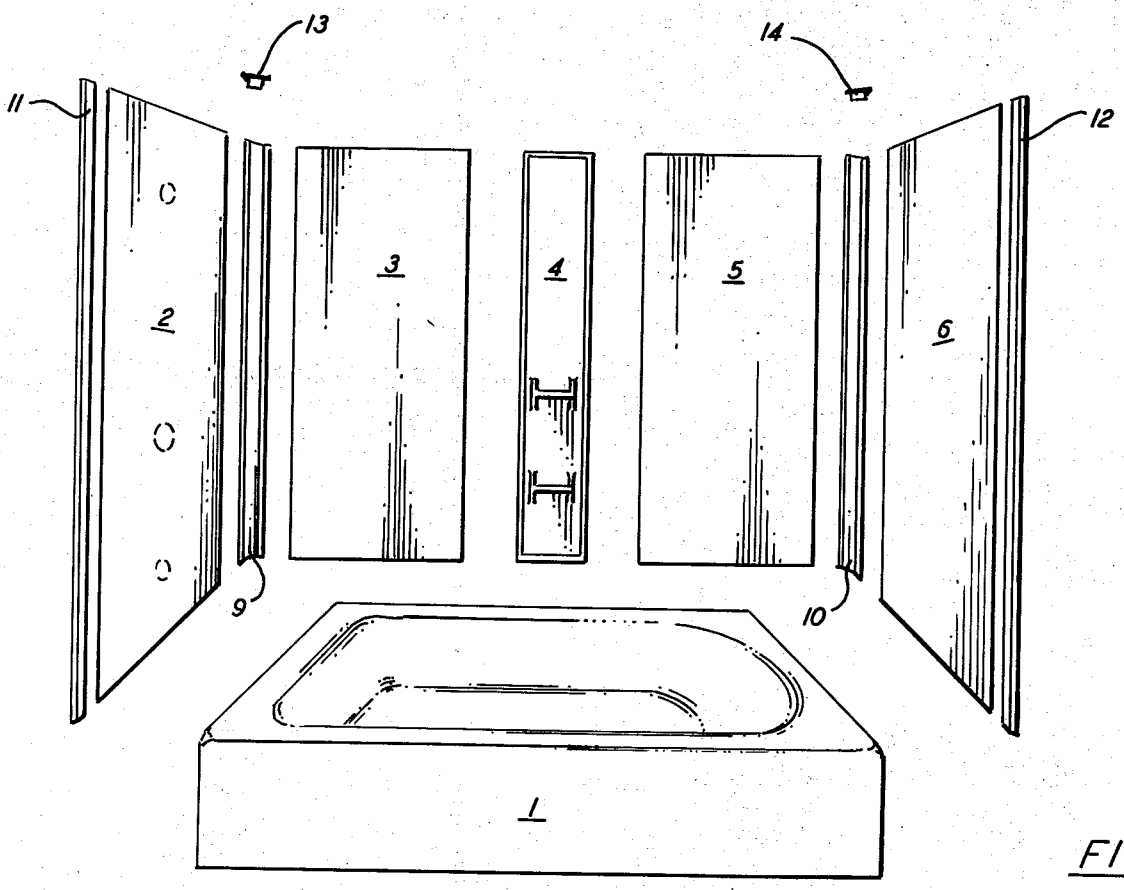
FIG. 2 is an exploded view of the wall surround of the invention, showing more clearly its separate elements.
Figure 7A:
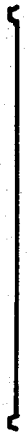
Figure 7B:
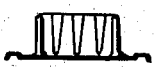
Figure 10:
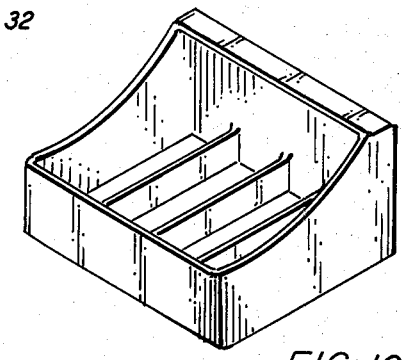
FIG. 10 depicts a form of tray used with the recess surround paneling system.

For a three sided tub recess, two such co-extruded panels, 3 and 5 in FIGS. 1, 1A and 2, are applied to extend the width of the back wall of the recess. At the center of the back wall, these plane panels are joined by center panel 4. The center panel, depicted in greater detail in FIG. 7, and in vertical and horizontal cross sections respectively in FIG. 7A and FIG. 7B, preferably consists of the same polymeric co-extruded material as the panels, but, after extrusion, is vacuum formed to provide a flange around the perimeter of the panel which is both decorative and provides sealing for joining the two back wall panels. Intrinsic trays, 7 and 8 for holding soap or other hygiene products used in bathing may also be vacuum formed into the center panel. Alternately, the center panel may include a flat surface and the trays may be provided separately to allow discretionary attachment to the tub surround panels at a location determined by the consumer to be most convenient. Such trays, if provided separately may be of the type depicted in FIG. 10 and would normally be applied to the panels, by a backing of double faced adhesive tape, or other suitable adhesive means, usually to provide an upper tray accessible while showering and a lower tray, accessible during bathing. Typical locations could correspond to the trays 7 and 8 in the center panel or in areas 20, 21, 22 and 23 indicated by the dotted lines in FIG. 1.

In the installation of the paneling the width and depth of the walls to be paneled are measured; it is determined whether the back or side panels require size adjustment along the breaking grooves. Normally, holes are provided to allow the passage of the plumbing fixtures through one side panel, as depicted in the finished stall of FIG. 1. Particularly for retrofit application, such holes are located and cut by the consumer. For original installations, these may be pre-cut in conventional, standardized locations.

In the example of the use of the kit as a tub surround, after sizing and hole cutting, side panels 2 and 6 and back panels 3 and 5 are applied to the respective walls with a construction adhesive. The back panels are applied so that one edge of each is at the corner. The gap between the two back panels is covered over with the center panel 4, which is also applied with a construction adhesive.

A number of sealing strips for sealing the corners between the back and side surfaces of the panels and the outer edges of the side panels are also provided for application after the panels are installed. The same strip which seals the corner is provided with a tear stripe or breaking groove in its center along which the strip may be divided to provide two edge sealing strips for sealing the outer edges of the side panels. Portions of the sealing strip may also be provided with further tear stripes or breaking grooves or in an alternative embodiment, with a hinged portion to allow particular adjustment for sealing the side panel edges over various thicknesses of existing wall coverings to which the wall paneling is applied. In this manner, a single strip may be provided to serve two functions, minimizing production and inventory requirements.

Figure 4:
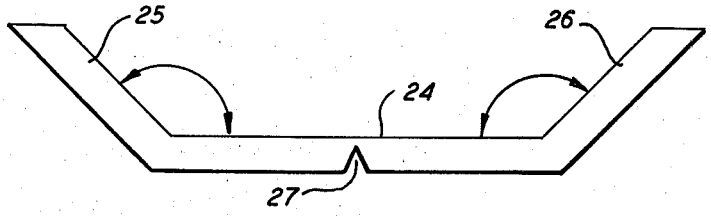
FIGS. 4, 4A, 4B and 5 are profiles, i.e. cross-sections, of extruded strips of the invention used for corner sealing between back and side panels and front edge sealing of the side panels.

A basic profile of such strips is depicted in FIG. 4. The strip includes a rigid extended central portion 24 from the ends of which, side elements 25 and 26 angularly project in an obtuse angle of about 135° and form a relatively perpendicular corner angle with respect to each other. The central portion includes a middle "breaking" groove, 27, in FIG. 4 or tear stripe, 27A in FIG. 4A. Additional breaking grooves or tear stripe sections may be included at other locations in the strip elements to provide for other particular application functions.

If a breaking groove is provided, preferably such strips will be extruded from a rigid plastic such as ABS or polyvinyl chloride. If a tear strip is provided, strips will preferably consist of a one piece extrusion of dual durometer plastic, preferably polyvinyl chloride. A rigid vinyl and a soft, flexible vinyl are coextruded to fabricate the strip. In the later case, as is known in the co-extrusion art, in making the strip, the rigid and flexible vinyl are fed into separate intake manifolds of an extruder and are simultaneously extruded through the same die at portions of the die corresponding to the predetermined portions of the dual durometer strip utilizing each type of plastic. The tear strip is formed of the softer, flexible plastic and the hard rigid plastic is used for the central and side elements.

The extrusion of such strips and selection of suitable plastics for use in accordance with the preferred embodiment are carried on in accordance with methods known in the art depending on design parameters and intended environmental conditions of use for particular applications.

Typical dimensions for such strips are in a range including a central portion of from about 1.5 inches to 3.0 inches in width from which side portions 0.5 inches to 1.5 inches long extend on each side. Breaking grooves have the same relative dimensions as do such grooves provided in the panels. The tear stripe of softer durometer plastic would be approximately 0.050 to 0.080 inches in width. Representative thicknesses of the strip would be from 0.040 inches to 0.070 inches for poly-vinyl chloride; if extruded from ABS, from 0.060 inches to 0.10 inches.

Figure 4A:
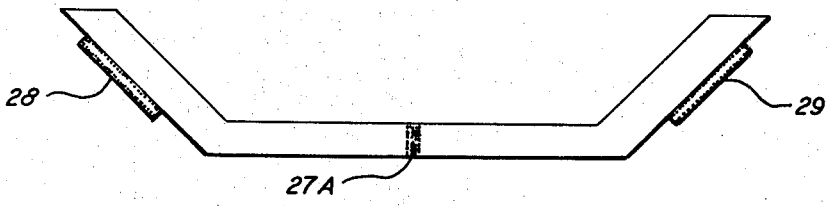

As depicted in FIG. 4A, this extruded strip provides a secure corner sealing strip for a tub wall surround as indicated at 9 and 10 in FIGS. 1, 1A and 2 when the side elements 25 and 26 are applied to overlap at the corner of the back and side panels of the tub enclosure. Adhesive means, indicated by 28 and 29 in FIG. 4A, such as double faced adhesive tape or other type of construction sealing adhesive is applied to the "outer" facing of the sides of the strips for overlapping attachment to the vertical edges of the back and side panels at the corner.

Such profile strips are also useful for sealing the front edge of the side panels of the tub enclosure, as indicated at 11 and 12 in FIGS. 1, 1A and 2, when the strip is separated into two separate pieces along the tear stripe or breaking section in the middle of the strip.

Figure 4B:
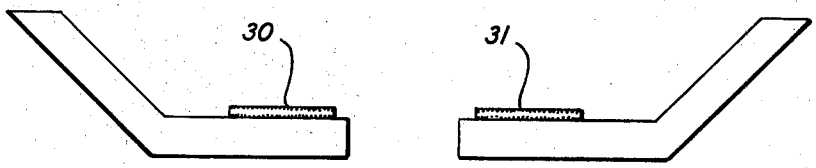

When the stripe is separated along its middle breaking groove or tear stripe, two separate edge sealing members, as depicted in FIG. 4B, are provided to seal the outward facing edges of the side panels. In this embodiment, adhesive means, such as the double faced adhesive tape indicated at 30 and 31 in FIG. 4B, is provided on the inward facing side of the portions of the strips for overlapping attachment over the edge of the side panel.

In this application the strips provide the edge sealing strips for paneling as indicated at 11 and 12 in FIGS. 1, 1A and 2. In lieu of separating the strip, profile extrusions for edge strips having the cross-section depicted in FIG. 4B may be separately provided.

The strips may also be provided with further tear stripes or breaking sections along side elements 25 and 26 so that, when used as an edge sealing strip, the length of the protruding element overlapping the edge of the side panel may be adapted to the thickness of the paneling plus the adhesive elements and the existing wall over which the new paneling is applied. These would ordinarily be adapted to be adjustable to provide sealing over the new paneling applied, and existing panels which are usually a standard 0.125 and 0.25 inches in thickness.

Figure 9:
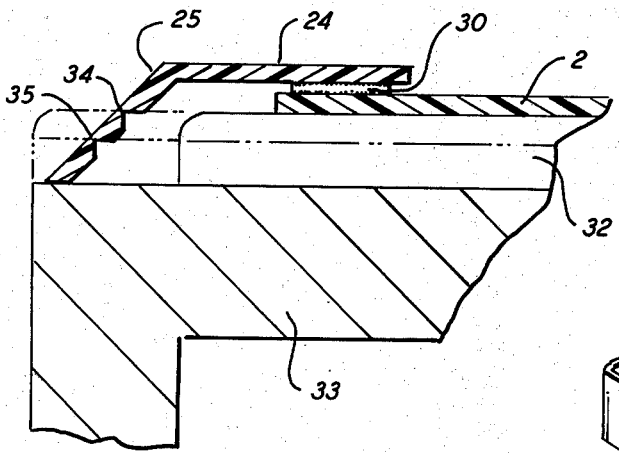
FIG. 9 is a profile of an embodiment of a strip of the invention and also depicts a cross section of side edge panel seal effected with strips of the invention.

The application of such a strip is depicted in FIG. 9 detailing in cross section the application of an edge strip. In FIG. 9, an edge profile including side portion 25 obtusely extending from central portion 24 is applied with double faced adhesive tape 30 to the side edge of paneling 2 which is installed in a retrofit or remodeling over an existing wall finish such as tile 32, which is in turn applied over the structural wall 33. When paneling is applied over an existing wall, it is desirable for aesthetic reasons as well as to provide a secure installation, that a side edge sealing strip overlap the existing wall finish such as wall tiling or panels 0.125 inch or 0.25 inch thick, as well as the retrofit panel applied. Accordingly, to provide optimum installation for such applications, the side edges of the strips are provided with tear stripes or breaking groove portions to allow adjustment of the width of the strip portion to provide a proper overlap for an optimum installation. In FIG. 9, additional tear stripes of a softer plastic, or breaking grooves are indicated at 34 and 35. A first location, 34 allows optimum adjustment of the edge seal over an extruded panel of the invention plus the thickness of the adhesive tape. A second location 35 is adapted for an additional 0.125 inches of existing tile. Without adjustment along a groove or stripe, the strip covers for 0.25 inches of existing tile. To effect adjustment, the edge strip is separated along a respective tear stripe or breaking groove to provide the desired coverage at the side edge of the surround.

The tear stripes in the side portions of the dual durometer strip having the dimensions previously set forth would consist of a softer, flexible plastic and would be about 0.020 to 0.050 inches in width, extending the length of the strip. If breaking grooves were employed, such grooves would be sharply "V" shaped and usually not exceed in depth half the thickness of the strip.

Figure 5:
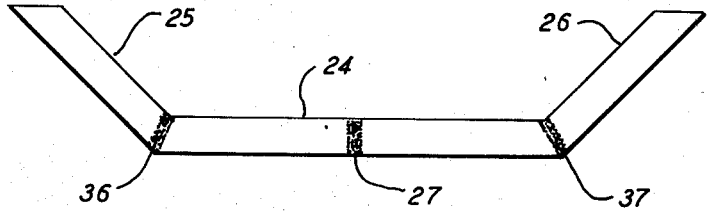

In an alternative embodiment depicted in FIG. 5, a dual durometer sealing strip is provided having a hinge between the central 24 and each side portion 25 and 26 of the sealing strip. Such hinge portions are indicated by 36 and 37 in FIG. 5. The hinge portion consists of a softer, flexible plastic portion about 0.020 to 0.050 inches in width. In this manner, when the strip is separated to provide edge sealing strips, or if separate edge profiles are extruded the hinge of the strip allows the side element to adjust, in a hingingly resilient manner to the thickness of the existing wall, without the need for cutting of the strip. Such strips would not be provided with further tear stripes or sizing grooves.

In the foregoing kit, normally after the panels are installed and the sealing strips attached, the edges will be caulked to provide additional sealing to effect water tightness. At the top of the corner of the recess, the corner sealing strip leaves a relatively triangular gap between the sealing strip and the wall corner. A cap, such as depicted in FIG. 8, may be provided for insertion in the open upper end of each corner.

In one form, a tub surround kit may be provided as a boxed unit, with installation instructions, and consisting of, as described herein, two back panels 26 inches×60 inches, two side panels 28 inches by 60 inches, an appropriate center panel 10 inches×60 inches and two strips of corner molding and two strips of side edge molding 60 inches long. Preferably one side of the double faced adhesive tape would be applied to the molding strips supplied. Depending on the type of center panel, separate soap trays may also be provided; and two corner caps may also be supplied. Because of the relatively plane shape of elements provided in the kit, such elements are conveniently nested for packaging and a further problem that the prior art, has dealt with, such as referred to in U.S. Pat. No. 3,996,703, is thereby solved in another manner.

The individual elements of the invention may also be separately provided, as they may also be useful for other applications.

Figure 11:
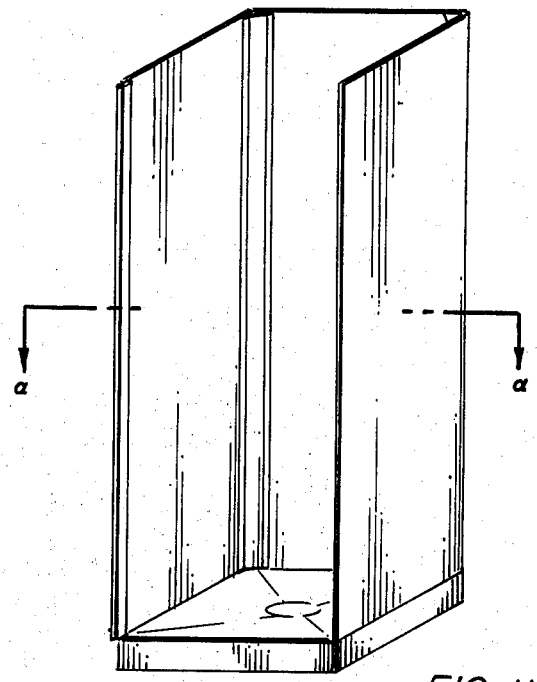
FIG. 11 depicts in perspective an alternate installation of the paneling system in a shower stall recess.
Figure 11A:
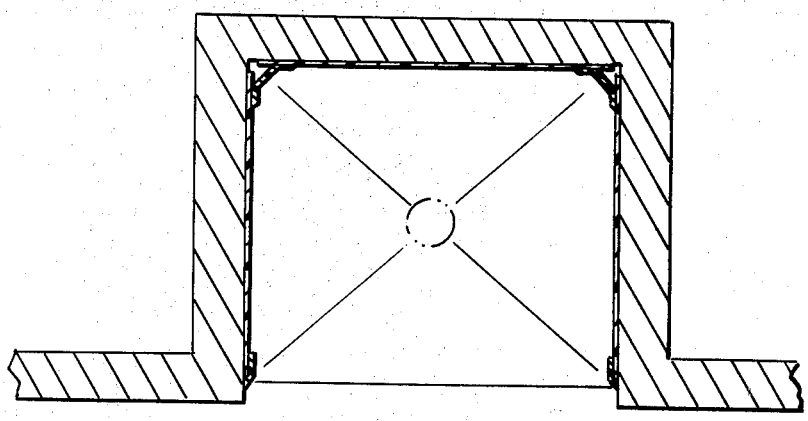
FIG. 11A depicts a horizontal cross-section thru the paneling system of FIG. 11 at line a—a.

Thus, in other forms, a recess paneling kit may also be applied for a shower stall recess, as shown in FIG. 11 and FIG. 11A or applied in an "L" shaped recess or for a diagonally installed tub as shown respectively in FIG. 12 and FIG. 12A. For such applications, panelling and the corner and side edge sealing strips are adapted in height for the intended use, and the panelling may be adapted in width for a pre-existing application by means of the breaking groove and center jointer panels provided.

In the foregoing specification, I have set forth the preferred embodiment of my invention. Other variations thereof may be apparent, without departing from the spirit of the foregoing, which I claim as follows:

What is claimed is:

1. A kit for providing protective paneling for a walled recess, having a back wall extending along the width of the recess and at least one side wall extending along the depth of the recess, the kit including 1. paneling members co-extruded from at least two different polymeric materials, said paneling members including
   (a) back paneling sufficient to extend the width of the recess;
   (b) at least one side paneling member sufficient to extend the depth of the recess;
   said back and side paneling members being approximately equal in height;
2. At least one corner joining strip extruded from a polymeric material and adapted to join the back and side panel at an inside corner of the recess, the corner joining strip:
   (i) consisting of a pair of rigid side portions each of which normally obtusely extends integrally from a substantially rigid laterally extensive central portion,
   (ii) being cross-sectionally symmetrical and having side portions perpendicular with respect to each other so that the outer surfaces of the side portions coincide with respect to perpendicular surfaces forming an inside corner, and
   (iii) having means for adhesively attaching the strip to the panels at the inside corner, said adhesive means being applied to the outer surfaces of each of the obtusely extending side portions;

3. at least one edge sealing strip extruded from polymeric material and adapted to protectively overlap the terminal edge of the at least one side panel applied to the wall, (i) said edge strip having two substantially rigid longitudinally extending portions in a lateral normally obtusely angled relationship, (ii) said strip including on one portion, on the inward facing surface of the obtuse angle, adhesive means for attachment of the strip to the outermost surface of the side panel at the extending terminal edge thereof, (iii) said strip being further adapted to provide an adjustable overlap with respect to the terminal edge of a panel and an existing wall surface by means of one of: (A) a resilient hinge portion connecting and being co-extensive with the two rigid longitudinally extending portions; and (B) means for separation of a longitudinal end segment from the width of the other portion of the strip, said means consisting of at least one of (1) a longitudinal breaking groove and (2) a narrow longitudinally extending dividing stripe consisting of co-extruded flexible polymeric material of a softer durometer than the durometer of the polymeric material from which the rigid portions are formed, the said one of a breaking groove and dividing stripe being adapted to allow the separation of a longitudinal end segment from the portion.

2. The kit of claim 1 in which the adhesive means of the corner joining strips and the edge sealing strips is a double faced adhesive tape.

3. A kit in accord with claim 1 in which the back paneling member consists of two substantially flat rectangular sheets intended to be applied adjacent each other along the width of the recess and the kit further includes a center panel which coveringly joins the two rectangular sheets comprising the back paneling;

and in which a pair of each of side paneling members, corner joining strips, and edge sealing strips are provided in the kit.

4. The kit of claim 3 in which the center panel includes at least one molded tray.

5. The kit of claim 3 in which the center panel includes a relatively flat, plane surface and the kit includes at least one separate tray for discretionary attachment to the paneling.

6. The kit of claim 1 further including at least one cap to plug a triangular opening between a recess corner and a corner sealing strip.

7. A paneling kit in accord with claim 1 including:

a back paneling member and two side paneling members, the back and side paneling members being approximately equal in width, and a pair each of corner joining strip and edge sealing strip.

8. The kit of claim 3 or claim 7 in which at least one paneling member is a co-extruded panel of a polymeric material and includes an extruded thick base portion of a structural plastic about 0.050 to about 0.080 inch in thickness co-extruded with a relatively thinner portion of a protective plastic about 0.002 to about 0.025 inch in thickness.

9. The kit of claim 3 or claim 7 in which at least one paneling member is an extruded panel which includes a linear groove through a portion of the thickness therein along its length, the groove being a breaking groove allowing said panel to be accurately linearly separated into portions along the groove, the groove further being located adjacent the end of a side of the panel at a predetermined location spaced from the end of the panel width, thereby allowing the size of the panel to be approximately adjusted to the pre-existing width of at least one wall of the recess.

* * * * *